US007108539B2

(12) United States Patent
Gunreben et al.

(10) Patent No.: US 7,108,539 B2
(45) Date of Patent: Sep. 19, 2006

(54) PLUG CONNECTOR HAVING A SECONDARY LOCKING SYSTEM THAT ENGAGES DURING PLUG INSERTION

(75) Inventors: Michael Gunreben, Burgthann (DE); Vincent Regnier, Nürnberg (DE)

(73) Assignee: FCI, Versailles (FR)

( * ) Notice: Subject to any disclaimer, the term of this patent is extended or adjusted under 35 U.S.C. 154(b) by 0 days.

(21) Appl. No.: 10/489,475

(22) PCT Filed: Jun. 2, 2003

(86) PCT No.: PCT/EP03/05760

§ 371 (c)(1),
(2), (4) Date: Jul. 26, 2004

(87) PCT Pub. No.: WO03/103102

PCT Pub. Date: Dec. 11, 2003

(65) Prior Publication Data

US 2004/0248454 A1 Dec. 9, 2004

(30) Foreign Application Priority Data

Jun. 4, 2002 (DE) ..... 102 24 757

(51) Int. Cl.
*H01R 13/627* (2006.01)

(52) U.S. Cl. ..... 439/352

(58) Field of Classification Search ..... 439/352, 439/350, 353, 355, 358, 752
See application file for complete search history.

(56) References Cited

U.S. PATENT DOCUMENTS 5,275,575 A * 1/1994 Cahaly et al. ..... 439/188
5,314,345 A * 5/1994 Cahaly et al. ..... 439/188
5,720,623 A * 2/1998 Polenick et al. ..... 439/352
6,004,158 A * 12/1999 Ward ..... 439/595
6,705,886 B1 3/2004 Brown ..... 439/489
6,811,424 B1 11/2004 Seminara et al. ..... 439/352
6,945,801 B1 9/2005 Brown ..... 439/188
2001/0027043 A1* 10/2001 Shiraki et al. ..... 439/188
2002/0081888 A1* 6/2002 Regnier et al. ..... 439/352
2002/0111060 A1* 8/2002 Challis et al. ..... 439/352

FOREIGN PATENT DOCUMENTS

| | | |
|---|---|---|
| DE | 1006621 | 4/1957 |
| DE | 4317344 A1 | 12/1994 |
| DE | 4430358 A1 | 4/1995 |
| DE | 197 04 991 A1 | 8/1997 |
| DE | 19621616 A1 | 12/1997 |
| DE | 100 25 295 A1 | 1/2002 |
| EP | 1130692 A2 | 9/2001 |
| EP | 1207591 A2 | 5/2002 |
| GB | 2 310 087 A1 | 6/1997 |

* cited by examiner

*Primary Examiner*—Chandrika Prasad
(74) *Attorney, Agent, or Firm*—Harrington & Smith,LLP

(57) ABSTRACT

The invention relates to a plug connector, particularly for airbag activation systems, comprising locking tongues (2), which are oriented in the direction of plugging-in and provided for locking the plug connector (1) inside a mating connector (3), and comprising a secondary locking system (4). This secondary locking system (4) has secondary locking tongues (4*a*, 4*b*) that are joined to the plug connector (1) in a fixed manner. When locking tongues (2) engage inside the mating connector (3), said secondary locking tongues elastically spring into the space (5) between locking tongues (2) and the plug connector body (6) while engaging therewith.

15 Claims, 8 Drawing Sheets

PLUG CONNECTOR HAVING A SECONDARY LOCKING SYSTEM THAT ENGAGES DURING PLUG INSERTION

FIELD OF THE INVENTION

The present invention concerns a plug connector according to the preamble of patent claim 1. Such plug connectors principally find application in airbag triggering systems.

BACKGROUND OF THE INVENTION

The highest requirements are placed on the reliability of such plug connectors and the plug connections produced with them. On the one hand, these requirements involve their reliability over a long period of time and, on the other hand, undefined stress states on the trigger must be avoided in producing the plug connector. For example, it must be assured that, it is abundantly clear to the operator that the plug connector is correctly seated in its final position in the counter-plug, which is conventionally assured by a lock or a catch, and, on the other hand, it must be assured that this final position is not abandoned unintentionally when the vehicle is operated and in particular, during repair operations on the motor vehicle. This is achieved by a secondary lock, i.e., the locking of catch arms in their locked position, so that the plug connection can no longer by disengaged unintentionally.

Known plug connectors for airbag triggering systems, as are known, for example, from DE 125,295 A1 of the patent applicant, use secondary locks which can only be activated if the plug connector is already plugged into the corresponding counter-plug. That is, in the mounted position, the secondary lock is found locked in an intermediate position, from which it is brought into its final position after producing the plug connection with the counter-plug. The plug connector is thus delivered with a secondary lock in an intermediate position, whereby it may happen during delivery or in the handling of the plug connector that the secondary lock is found unintentionally already in its final position, as if the plug connection has been produced, but in this case, connection is prevented. The secondary lock can be disengaged again, but additional time is required and an optional automatically produced installation is made impossible. In addition, after the plug connection has been produced, one may forget to also lock the secondary lock, so that it cannot be excluded with certainty that the plug connection can be disengaged again.

SUMMARY OF THE INVENTION

The object of the invention is to extensively improve a plug connector of the given type, so that a secondary locking need no longer be made separately after the connection with a counter-plug has been made, but can be made simultaneously when the plug connector and counter-plug are connected.

This object is solved according to the claim.

Preferred configurations of the plug connector according to the invention are characterized in the subclaims. The principle of the present invention consists of the fact that the radial tilting movement of a locking tab by catching under the corresponding shoulder in the counter-plug is used for controlling the movement of secondary locking tabs, which are prestressed during the process of plugging in, so that when the locking tabs are locked in, the path is made free for the secondary locking tabs to move by their free ends behind the locking tabs in order to make impossible a disengagement of the locking tabs.

BRIEF DESCRIPTION OF THE DRAWINGS

The invention will be explained in more detail in the following based on the description of embodiment examples with reference to the drawing, in which the following are shown.

DETAILED DESCRIPTION OF THE INVENTION

Figure 1:
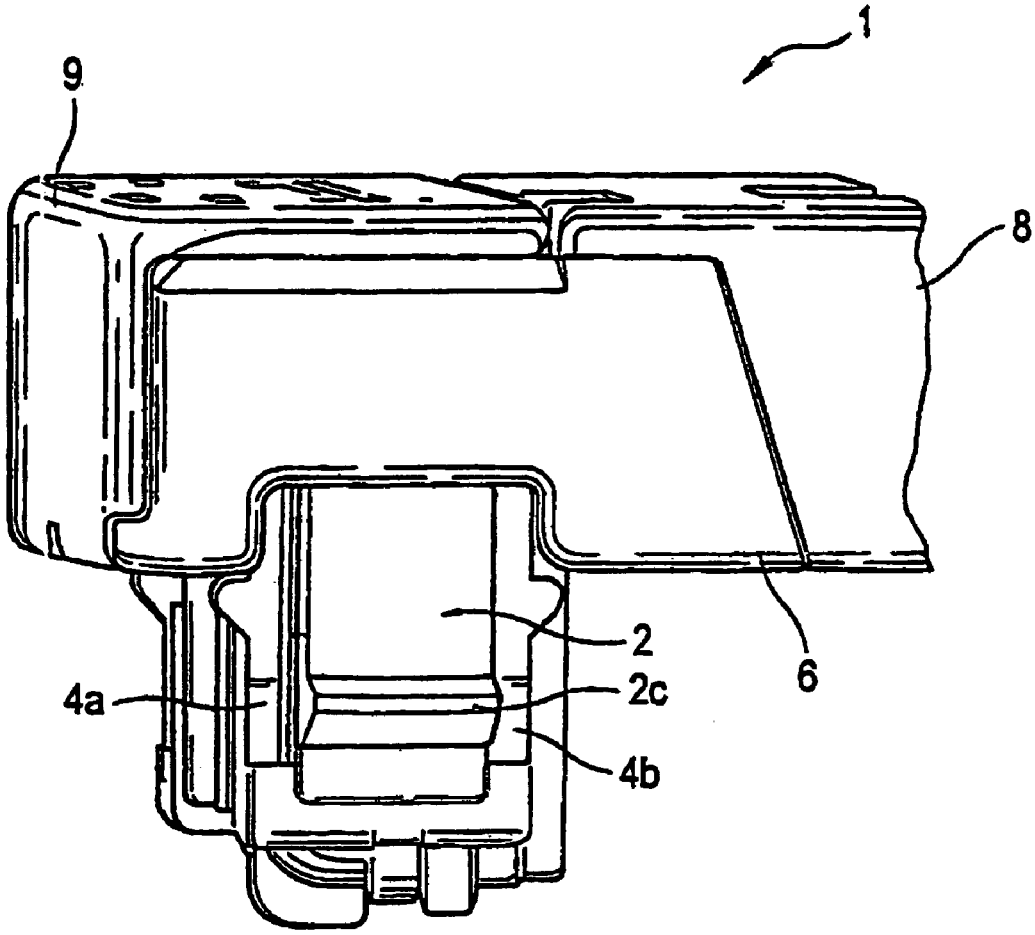
FIG. 1: an embodiment of the plug connector according to the invention in lateral view.

FIG. 1 shows the plug connector 1 according to the invention with a housing, which essentially comprises the plug connector body 6, the cover 8, and the clamping piece 9. The plug part extends at a right angle from the flatly constructed housing. The plug part has locking tabs 2 for locking the plug connector 1 in a counter-plug 3. From clamping piece 9, which is fastened to the plug connector body 6 by locking or catching, secondary locking tabs 4*a*, 4*b* project in the plugging-in direction on both sides of locking tabs 2.

Figure 2:
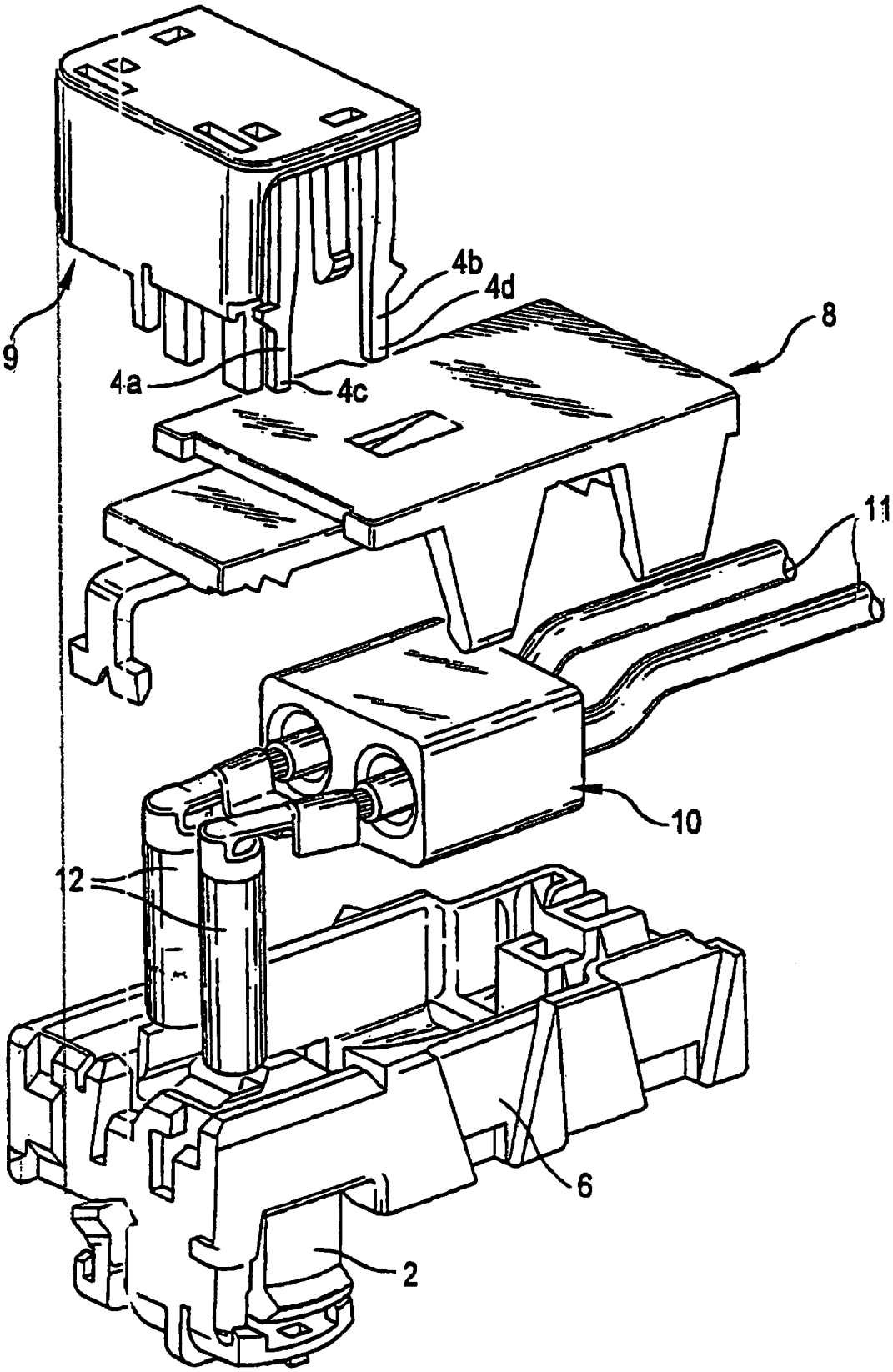
FIG. 2: an exploded representation of the essential components of the plug connector according to FIG. 1.

FIG. 2 shows the essential components of the plug connector according to the invention in an exploded representation. From bottom to top, the plug connector comprises the plug connector body 6, on the plug part of which are formed the locking tabs 2. The cables 11, which are guided through a ferrite core 10 and crimped with plug connector sleeves 12, are inserted into plug body 6. The plug connector is closed off by a cover 8, onto which is plugged the clamping piece 9 above the plug part. The fastening of all housing parts with one another is made each time by a locking or catching.

Figure 3:
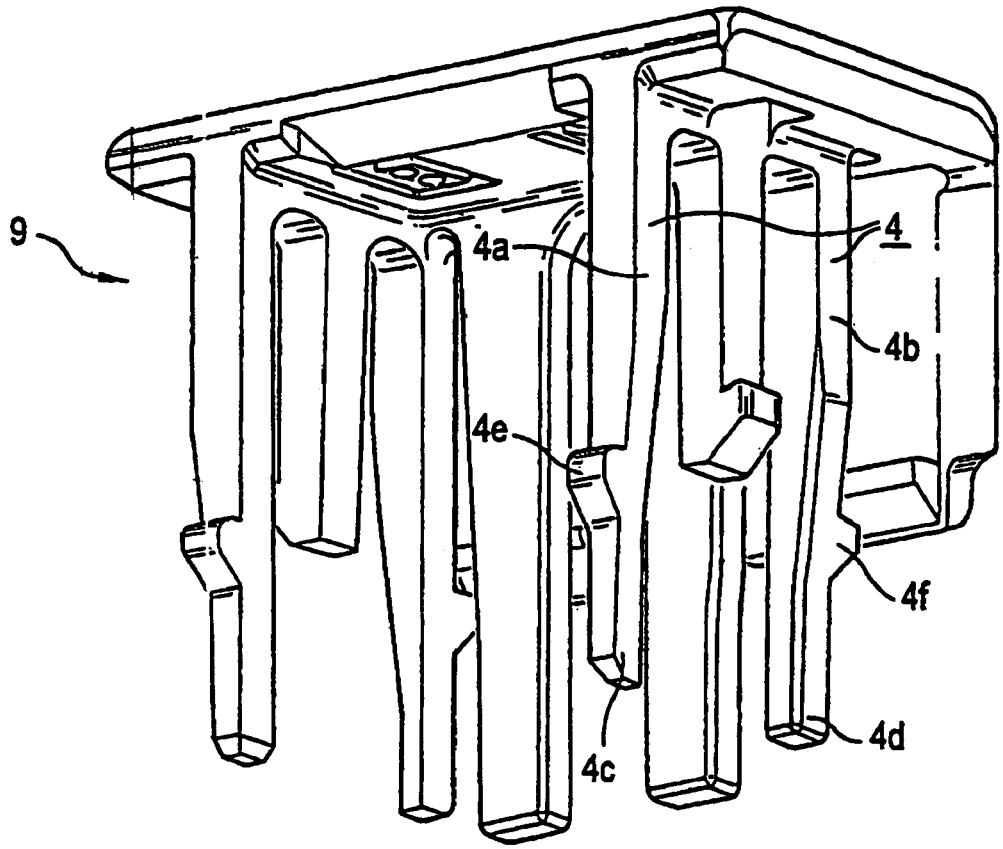
FIG. 3: the clamping piece 9 with secondary locking tabs formed thereon.

FIG. 3 shows the clamping piece 9 in perspective view. In addition to the locking tabs, which are not shown in more detail here, for locking or catching the clamping piece to the plug connector body 6, one recognizes 2 pairs of secondary locking tabs 4*a*, 4*b*, on whose sides turned away from one another are formed wedge-shaped projections 4*e*, 4*f*. It is further recognized that the profile of the secondary locking tabs 4*a*, 4*b* taper into free ends 4*c*, 4*d*.

Figure 4B:
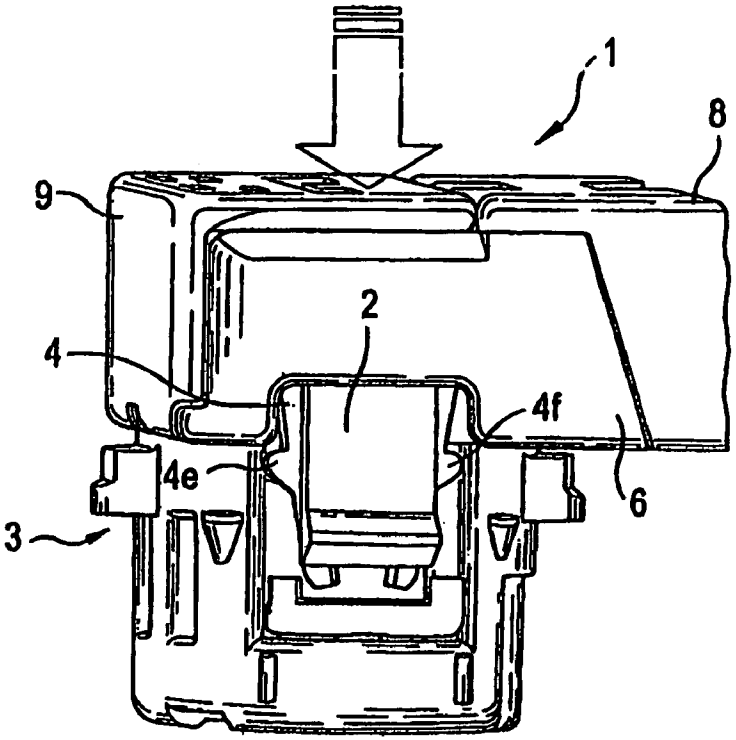
FIGS. 4*a*, 4*b*: the plugging-in process of the plug connector according to FIG. 1 into a counter-plug, partially cut away.
Figure 4A:
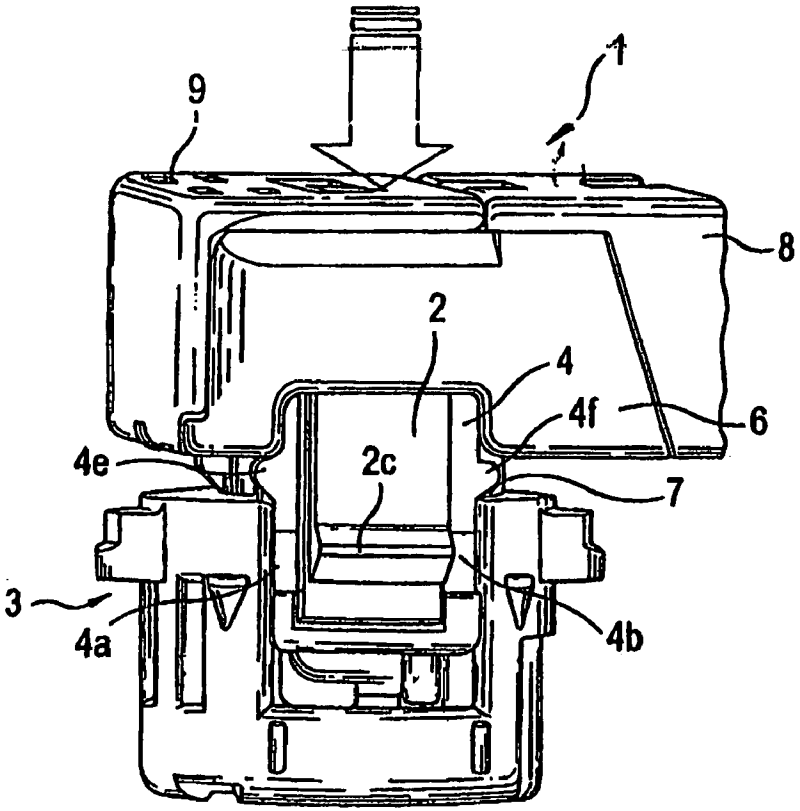

FIGS. 4*a* and 4*b* show the plugging-in process of plug connector 1 into a counter-plug 3. Only one inlet is shown of counter-plug 3, which is cut open in the region of the locking tabs 2, in order to show the plug part of the plug connector 1. FIG. 4*a* shows the plug connector 1, which is plugged into counter-plug 3 far enough that the wedge-shaped projections 4*e*, 4*f* are applied onto the upper edge of a guide slot 7 in the counter-plug 3. In this position, a catch piece 2*c* at the same time strikes against a catching shoulder (which is not shown in this illustration) on counter-plug 3, so that when plug connector 1 is pressed further into counter-plug 3, as shown in FIG. 4*b*, the locking tabs 2 bend when they project over the shoulder in the direction of the plug-in axis.

This bending of locking tabs 2 leads to the circumstance that projection 2*d* (see FIG. 5) is moved in the direction of the plug-in axis and thus offers the free ends 4*c*, 4*d* of the secondary locking tabs 4*a*, 4*b* a bearing surface. When plug connector 1 is pushed in further, the central regions of secondary locking tabs 4*a*, 4*b* bend due to the contact of wedge-shaped projections 4*e*, 4*f* with the narrow sides of the guide slot 7 to such an extent that these central regions bend into a space 5 between the locking tabs 2 and the plug connector body 6.

In the locked state, i.e., plug connector 1 is completely plugged into counter-plug 3, the locking tabs 2 spring back again into their initial position, after they have projected over the (not shown) catching shoulder in counter-plug 3. Simultaneously, they again release the space 5 in the region of the free ends 4*c*, 4*d* of the secondary locking tabs 4*a*, 4*b* and thus a bearing surface is not longer offered, so that, due to the elastic bending of the secondary locking tabs 4*a*, 4*b* they spring behind the locking tabs 2 into space 5, as this is shown in FIG. 4*b*. The secondary locking is produced in this way, since the locking tabs 2 can no longer move from their locked position in the direction of the plug-in axis.

Figure 5:
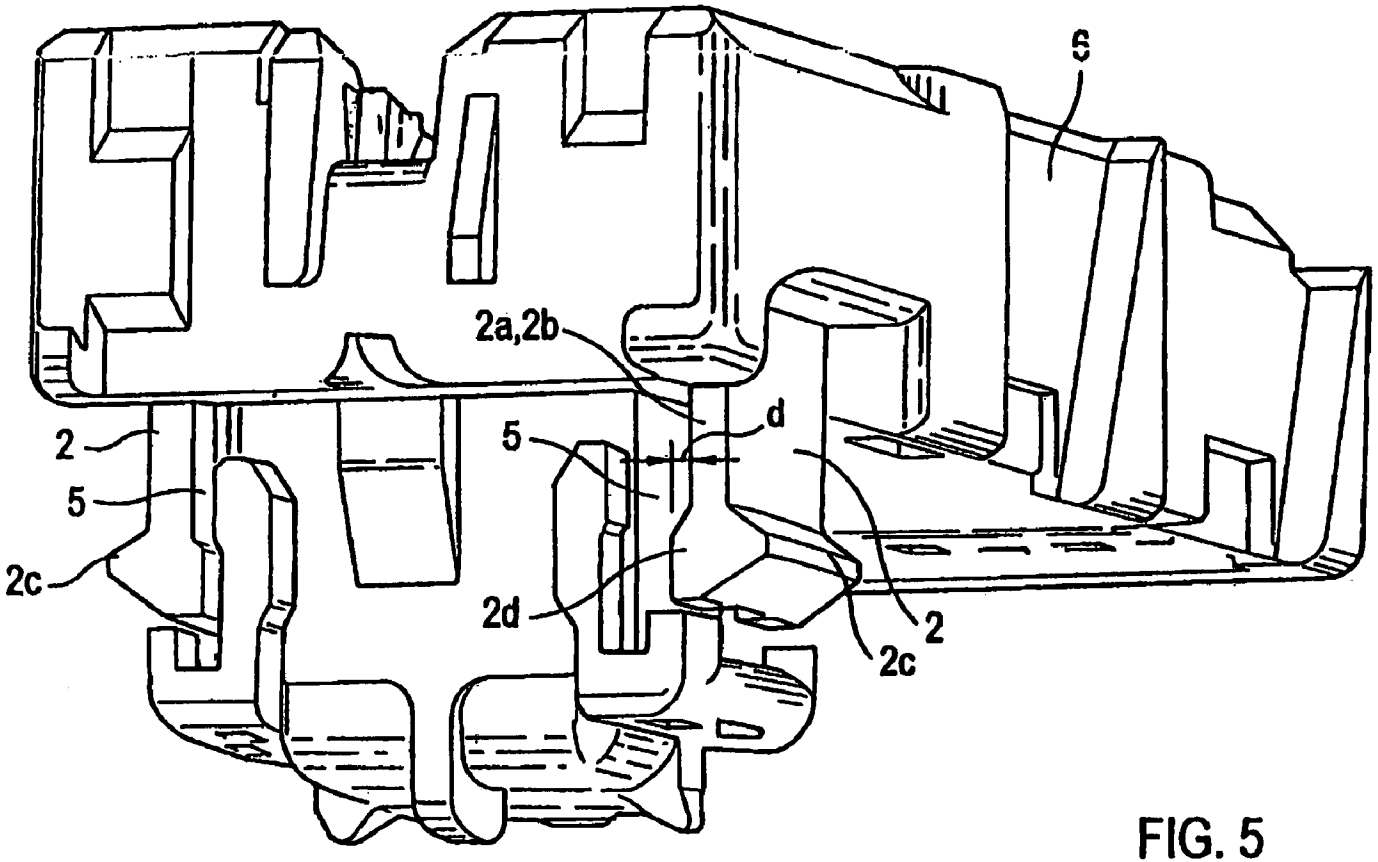
FIG. 5: the plug connector body with locking tabs.

FIG. 5 shows the plug connector body 6 alone, wherein one can clearly recognize space 5 between plug connector body 6 and locking tabs 2. One can further recognize the configuration of catch piece 2*c* on locking tabs 2 and the projection 2*d* on the opposite-lying side, whose width d, which is also shown, corresponds to the amount by which the profile of the secondary locking tabs shown in FIG. 3 taper into their free ends 4*c*, 4*d* in this region.

Figure 6:
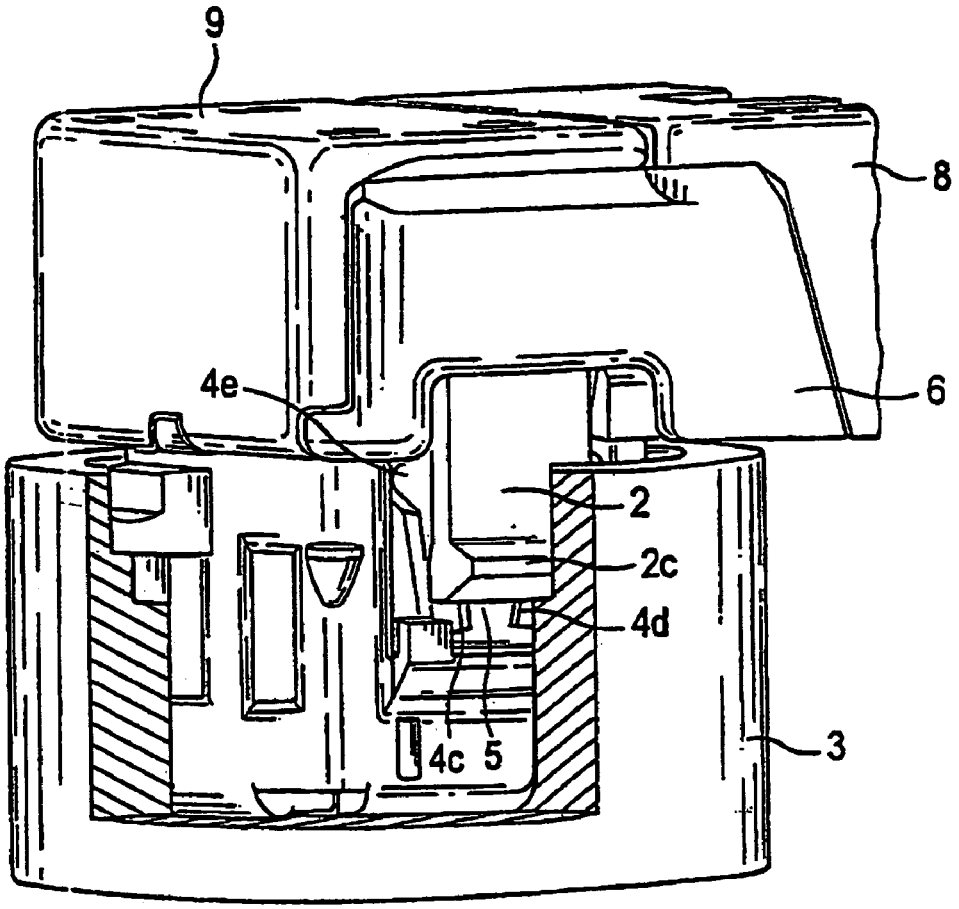
FIG. 6: the plug connector according to FIG. 1 in the state locked in the counter-plug.

FIG. 6 shows once more a partially cut-open view of the plug connector 1 after locking in the counter-plug 3. It can again be clearly recognized that the free ends 4*c*, 4*d* of the secondary locking tabs 4 block a swinging back of locking tabs 2 into the free space 5.

Figure 7:
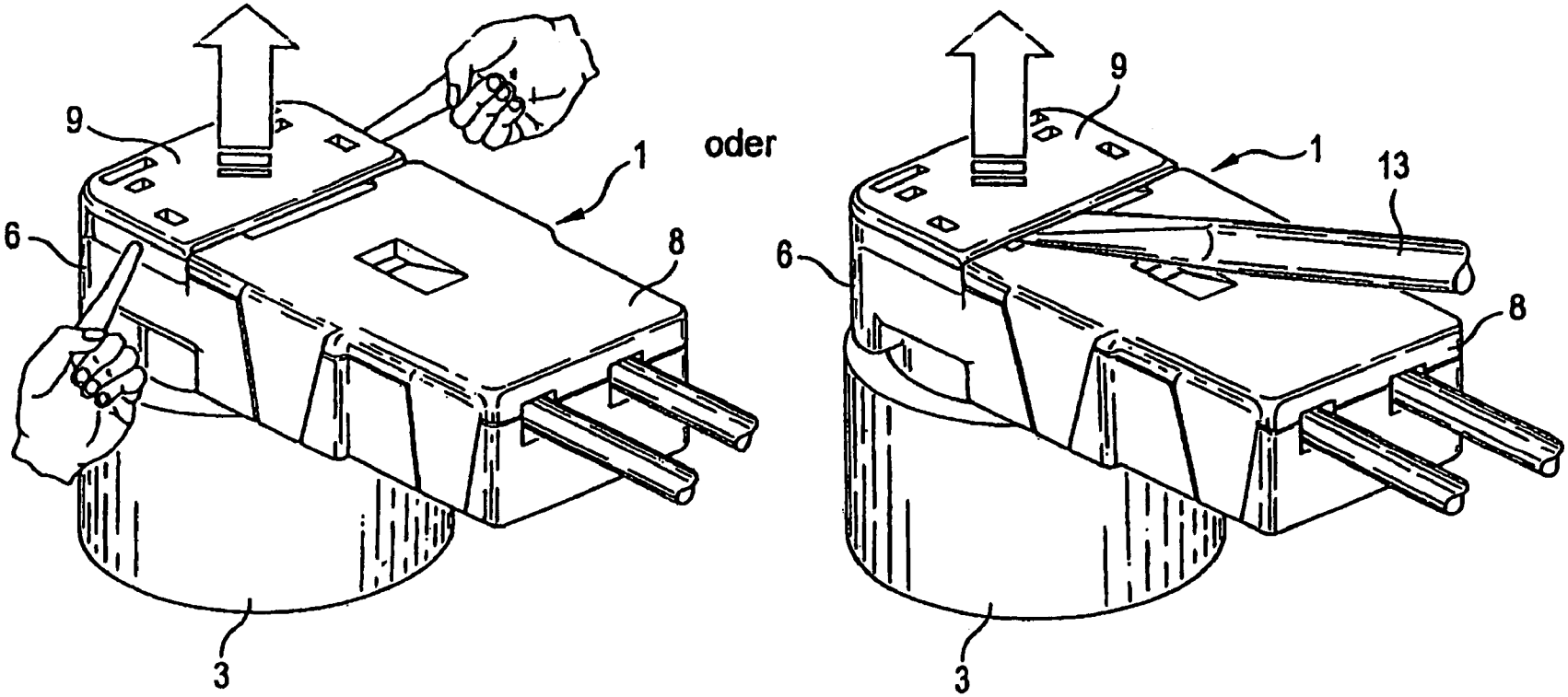
FIG. 7: the disengagement of clamping piece 9 from the plug connector.
Figure 8:
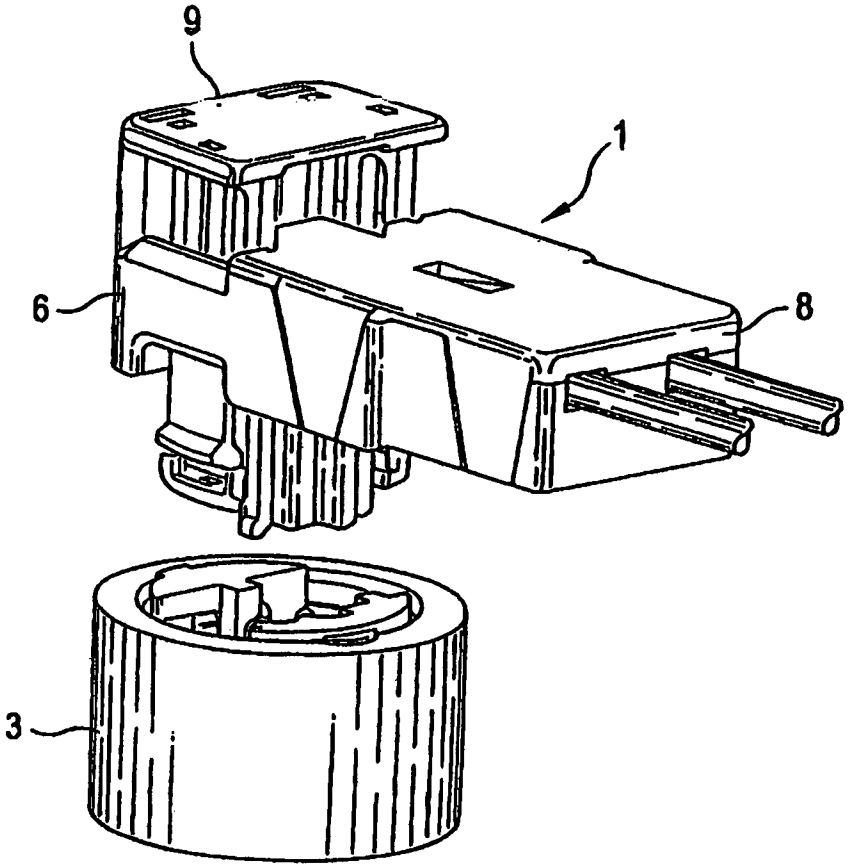
FIG. 8: the disengagement of plug connector 1 from the counter-plug 3 after disengaging the clamping piece 9.
Figure 8:
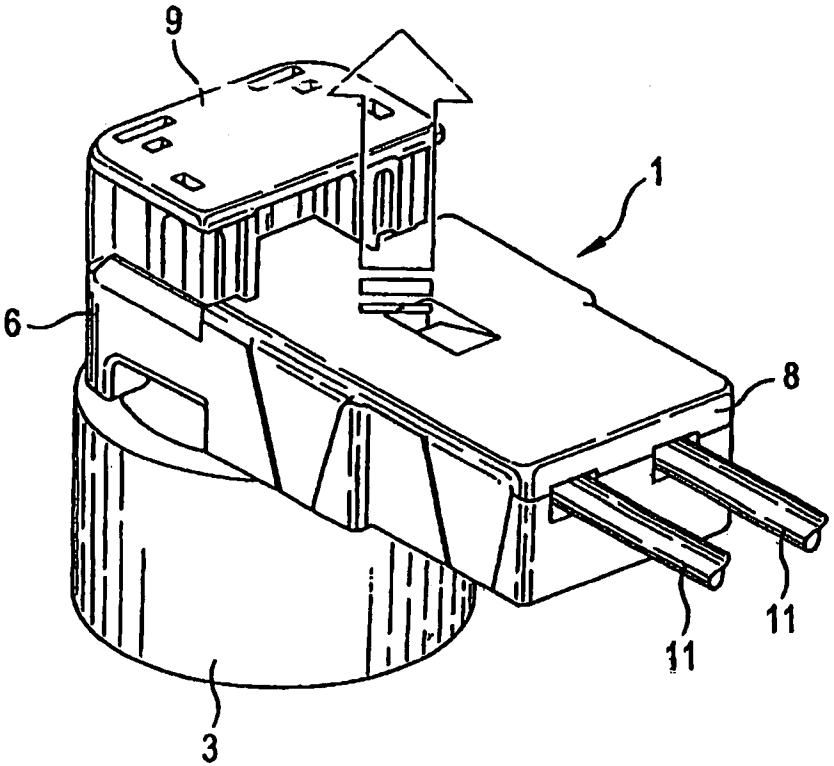

FIG. 7 shows 2 alternative possibilities of how one can disengage clamping piece 9 from plug connector 1. This is done either, as can be seen on the left, by grasping under the lateral edges of clamping piece 9 with the fingernails or fingers or with the help of a tool, for example, a flat screwdriver 13 or the like, which one inserts into a depression provided therefor, with which the tip of the screwdriver is guided under the cover of clamping piece 9. Then clamping piece 9 is pushed up, as is shown in FIG. 8, to such an extent that the secondary locking tabs are raised up enough that they no longer block a tilting of the free ends 2*c* of locking tabs 2 relative to the plug-in axis. In this position, as is shown in FIG. 8 on the right, the plug connector 1 can be removed from the counter-plug 3.

The preceding description of an example of embodiment of the present invention is not to be understood as limiting, but serves only for illustration of the invention defined in the claims.

The invention claimed is:

1. A plug connector, for an airbag triggering system, with primary locking tabs arranged in a plugging-in direction, for locking or catching of the plug connector in a counter-plug, and with a secondary lock comprising secondary locking tabs, wherein when the primary locking tabs are locked in the counter-plug, these secondary locking tabs automatically spring elastically into a space between the primary locking tabs and a plug connector body of the plug connector and block the primary locking tabs from being moved back into the space.

2. The plug connector according to claim 1, further characterized in that the secondary locking tabs run parallel to both sides of the primary locking tabs, and free ends of the secondary locking tabs press elastically at their side edges against the primary locking tabs as long as the primary locking tabs are bent toward the plug-in axis during a locking process of insertion of the plug connector into the counter-plug, wherein the pressing pressure is produced by wedge-shaped projections which are arranged on outer sides of the secondary locking tabs and which are supported on the counter-plug, and which, as soon as the primary locking tabs are locked in the counter-plug, spring by their free ends into the space between the plug connector body and the primary locking tabs and lock the primary locking tabs in a locked position.

3. The plug connector according to claim 2, further characterized in that the primary locking tabs have free ends with a catch piece for locking in the counter-plug on a side lying radially outside of a plug-in axis and a projection on a side lying opposite, on which the free ends of the secondary locking tabs press during the locking process.

4. The plug connector according to claim 3, further characterized in that when the plug connector is introduced into the counter-plug, the wedge-shaped projections are supported on narrow sides of introduction slots for the primary locking tabs and the secondary locking tabs, and thus the secondary locking tabs in their central region are elastically bent into the space between the primary locking tabs and the plug connector body and the free ends of the secondary locking tabs press against the projections.

5. The plug connector according to claim 4, further characterized in that the introduction slots are dimensioned such that after the primary locking tabs are locked in the counter-plug, the free ends of the secondary locking tabs are arrested by support of wedge-shaped projections on the narrow sides of the introduction slots in their locking position.

6. The plug connector according to claim 1, further characterized in that the secondary locking tabs are tapered in their radial width relative to free ends of the secondary locking tabs by a width of a projection at free ends of the primary locking tabs.

7. The plug connector according to claim 1, further characterized in that the secondary locking tabs are shaped on a clamping piece that can be locked in a detachable manner on a housing of the plug connector.

8. The plug connector according to one of claim 4, further characterized in that the wedge-shaped projections come to be supported on the narrow sides of the introduction slots, if the catch piece of the primary locking tabs is supported on a corresponding catching shoulder of the counter-plug.

9. An airbag electrical plug connector comprising:

electrical contacts; and a housing with a plug connector body, wherein the electrical contacts are at least partially located in the plug connector body, wherein the housing comprises a first spring-lock locking tab arranged in a plug-in direction for connecting to a counter-plug, and wherein the housing further comprises a second spring-lock locking tab, wherein, when the first locking tab is locked into the counter-plug, the second locking tab automatically springs into a space between the first locking tab and the plug connector body to block the first locking tab from being moved back into the space.

10. An airbag electrical plug connector as in claim 9 wherein the second locking tab comprises a projection, wherein when the airbag electrical plug connector is inserted into the counter-plug the projection contacts the counter-plug to deflect the second locking tab towards a side of the first locking tab and causing the second locking tab to resiliently deform between the counter-plug and the side of the first locking tab.

11. An airbag electrical plug connector as in claim 10 wherein, when the airbag electrical plug connector is inserted into the counter-plug, the first locking tab is resiliently deflected into the space and the second locking tab is prevented from entering the space until the first locking tab resiliently deflects out of the space at a final connected position of the first locking tab with the counter-plug.

12. An airbag electrical plug connector as in claim 9 wherein the housing comprises a clamping piece movably mounted to the plug connector body between a locked position and an unlocked position, wherein the clamping piece comprises the second locking tab, wherein the plug connector body comprises the first locking tab, and wherein the locked position comprises the second locking tab being located in a down position relative to the plug connector body.

13. An airbag electrical plug connector as in claim 12 wherein the airbag electrical plug connector comprises a pre-connection condition for insertion of the airbag electrical plug connector into the counter-plug comprising the clamping piece being located at the locked position.

14. An airbag electrical plug connector as in claim 9 wherein the housing comprises two of the second spring-lock locking tabs located on opposite sides of the first locking tab.

15. An airbag electrical plug connector comprising:

electrical contacts; and a housing with a plug connector body, wherein the electrical contacts are at least partially located in the plug connector body, wherein the housing comprises a first spring-lock locking tab arranged in a plug-in direction for connecting to a counter-plug, and wherein the housing further comprises a second spring-lock locking tab, wherein, when the first locking tab is inserted into the counter-plug, the first locking tab is adapted to deflect into a space and the second locking tab is adapted to resiliently press against a side of the first locking plug by the counter-plug, and when the first locking tab moves out of the space upon final connection of the airbag electrical plug connector to the counter-plug, the second locking tab is adapted to move off of the first locking tab and spring into the space to block the first locking tab from being moved back into the space.

* * * * *